US005525859A

United States Patent [19]

Ito et al.

[11] Patent Number: 5,525,859

[45] Date of Patent: Jun. 11, 1996

[54] COLOR CATHODE RAY TUBE

[75] Inventors: Yukio Ito; Jun Yamazaki, both of Aichi, Japan

[73] Assignee: Sony Corporation, Tokyo, Japan

[21] Appl. No.: 359,795

[22] Filed: Dec. 20, 1994

[30] Foreign Application Priority Data

Dec. 21, 1993 [JP] Japan ..... 5-346225

[51] Int. Cl.[6] ..... H01J 29/80

[52] U.S. Cl. ..... 313/402; 313/403; 313/407; 313/408

[58] Field of Search ..... 313/369, 375, 313/385, 402, 407, 408, 469, 470, 269, 403

[56] References Cited

U.S. PATENT DOCUMENTS

| | | | |
|---|---|---|---|
| 4,504,764 | 3/1985 | Sakamoto et al. . | |
| 5,111,107 | 5/1992 | Kume et al. . | |
| 5,382,871 | 1/1995 | Funahashi | 313/402 |
| 5,394,051 | 2/1995 | Lerner | 313/403 |

*Primary Examiner*—Sandra L. O'Shea
*Assistant Examiner*—John Ning
*Attorney, Agent, or Firm*—Jerry A. Miller; Pasquale Musacchio; Karin L. Williams

[57] ABSTRACT

A color cathode ray tube having an electron beam source has a glass panel with a plurality of fluorescent stripes and a plurality of black stripes located between each two adjacent fluorescent stripes. An aperture grill is located between the electron beam source and the glass panel. A plurality of parallel grill tapes are located between an upper part and a lower part of the aperture grill, and a plurality of slits are provided between each two adjacent grill tapes. The inside stress of a center grill tape is expressed by α, the length of the grill tape at a center of the aperture grill is expressed by $L_0$, and a grill tape pitch of the aperture grill is expressed by $P_{ag}$. The inside stress is expressed by the following formula:

$$\alpha > (L_0/P_{ag})^{0.725} * (1.329 * 10^{-2} * L_0 + 5.354) * 10^{-2}.$$

The above formula for the inside stress of a center grill tape in a color cathode ray tube having an aperture grill, acts so as to reduce picture quality deterioration generated by a vibration, such as voice output from a speaker.

9 Claims, 7 Drawing Sheets

COLOR CATHODE RAY TUBE

FIELD OF THE INVENTION

This invention relates to a color cathode ray tube and more particularly relates to a color cathode ray tube having an aperture grill.

BACKGROUND OF THE INVENTION

A color cathode ray tube having an aperture grill is shown in FIG. 7.

Aperture grill 1 has an array of stripe-shaped slits 2 oriented in a vertical direction which are made by etching a thin sheet of metal. A metal strip located between two adjacent slits 2 is called grill tape 2*a*. A frame 3 is made by welding and unifying an upper part 4, a lower part 5, a right part 6 and a left part 7. The upper and lower ends of the aperture grill 1 are respectively welded to the upper part 4 and the lower part 5 of the frame so that each grill tape 2*a* is stretched between the upper part 4 and the lower part 5 with a predetermined tension.

A damper line 8 is stretched between two leaf springs 9 respectively attached to the right part 6 and the left part 7 along the surface of the aperture grill 1. The damper line 8 prevents a grill tape 2*a* of the aperture grill 1 from vibrating mechanically. A color cathode ray tube of 14–16 inch typically has a single damper line. A color cathode ray tube of 18–25 inch typically has two damper lines. A color cathode ray tube being bigger than 25 inch typically has three damper lines. Thus, the number of a damper line attached to a color cathode ray tube depends on the size of a color cathode ray tube.

FIG. 8 is a cross-sectional view of a fluorescent stripe and a carbon stripe. FIG. 8 shows an aperture grill 1, a slit 2, a grill tape 2*a*, a glass panel 10, a fluorescent stripe 11 and a carbon stripe 12 located between two adjacent fluorescent stripes. The fluorescent stripe 11 is repeatedly arranged in the order of red, green and blue stripes.

A white ratio defined by the formula (1) is approximately between 50% and 60% on a color cathode ray tube having an aperture grill.

$$\text{WHITE RATIO } [\%]=3W_{PS}/P_{SC}*100 \quad (1)$$

Here, $W_{PS}$ is the width of a fluorescent stripe. $P_{SC}$ is the length of from a red fluorescent stripe to the next red fluorescent stripe.

An electron beam 13 is emitted from an electron gun (not shown in figure). An electron beam 13 irradiates fluorescent stripes 11 on a glass panel 10 through a slit 2 of an aperture grill 1. As an example, the electron beam 13 of FIG. 8 irradiates a green fluorescent stripe.

A color cathode ray tube having an aperture grill has advantages over other types of color cathode ray tubes not having an aperture grill. However an aperture grill type color cathode ray tube has a disadvantage that a grill tape easily vibrates, for example, by a voice output from a speaker provided with a cathode ray tube in a television receiver or computer monitor because the width of a grill tape is very small. Such vibration can deteriorate the picture quality.

For instance, a 20 inch color cathode ray tube inch has a grill tape of length 286 mm, thickness 0.13 mm, and width 0.22 mm. A grill tape is regarded as a string relating to the vibration of a grill tape. Grill tape 2*a* moves in both the X axis and the Z axis directions as shown in FIG. 8. When a grill tape moves in the direction of the X axis, a misalignment 51 is created between the center of an electron beam 52 and the center of a fluorescent stripe 53 receiving the electron beam thereon. Thereby, the fluorescent stripe 11 has an area 55 where no light is emitted. The light emitting area of the fluorescent stripe 11 is shown as the number 54 in FIG. 8. When there is no discrepancy between the center of an electron beam 52 and the center of a fluorescent stripe 53 receiving the electron beam thereon, the entire fluorescent stripe 11 emits light.

The width of the area 55 in which no light is emitted is changed by the vibration of a grill tape 2*a*. Therefore, the quality of light emitting from the fluorescent stripe 11 is changed as shown in FIG. 9(A) and 9(B). FIG. 9(A) shows the quality of light changing over a very short time period. FIG. 9(B) shows a quality of light changing in a time period wherein the picture quality is deteriorated. The time period of FIG. 9(B) is comparatively longer than the time period shown in FIG. 9(A). The picture quality deteriorating time period is a time period when the picture is distorted by vibration of a grill tape 2*a*. The picture quality deteriorating time period includes a time period effected by vibration even after the cause of the vibration is removed. For example, a picture quality deteriorating time period might be on the order of 0.7 seconds.

The notations "RI", "L1" and "R2" of FIG. 9(A) each indicate a period of time wherein either a right (R) or left (L) side of the fluorescent stripe 11 is emitting no light due to misalignment of the strip 11 with the slit 2. For example, during time R1, fluorescent stripe 11 has an area 55 with no light emitted at the right side (R1). During time L1, stripe 11 has an area 55 on the left side wherein no light is emitted. The misalignment is maximum and thus the area 55 is maximum at about the center of time period R1, L1, R2, L2, etc., and thus the amount of light emitted from the strip 11 is lowest at the center of each of these time periods. Between these areas where the strip 11 is misaligned with the grill slit 2, the strip 11 is fully illuminated by beam 13 and thus emits maximum light.

The change of the quantity of light generated by area 55 attenuates as shown in FIG. 9(B) as time goes by, due to the attenuation of vibration as time goes by. When the vibration stops, the change of the quantity of light becomes zero.

The period time when a picture is affected by vibration of the grill tape 2*a* is called "picture quality deteriorating time period" shown as 60 in FIG. 9(B). The picture quality deteriorating time period 60 includes a time period caused by the vibration of the aperture grill which persists even after the cause of the vibration is removed. It is desired to shorten the picture quality deteriorating time period 60, for example to 0.5 seconds or less. This is especially the case for color cathode ray tubes used for a computer display. Since computer displays require very high picture quality, even small deterioration of picture quality is undesirable. Further, because a monitor for a computer display is now commonly used with a speaker, the picture deterioration generated by the speaker can not be ignored.

SUMMARY OF THE INVENTION

One object of the present invention is to provide a new and improved color cathode ray tube which uses an aperture grill and is more resistant to picture quality deterioration in the presence of vibration.

According to the present invention, a color cathode ray tube has an electron beam gun, a glass panel having a plurality of fluorescent stripes thereon and a plurality of black stripes located between two adjacent fluorescent stripes. Further the color cathode ray tube has an aperture grill located between the electron beam source and the glass panel. The aperture grill has a plurality of grill tapes provided in parallel to each other between an upper end and a lower end of the aperture grill. A plurality of slits are provided between two adjacent grill tapes. An inside stress of the grill tape is expressed by $\alpha$. A length of the grill tape provided at a center of the aperture grill is expressed by $L_0$. A grill tape pitch of the aperture grill is expressed $P_{ag}$. A relation among the inside stress of the grill tape, the length of the grill tape provided at the center of the aperture grill and the grill tape pitch of the aperture grill is expressed by the following formula.

$$\alpha > (L_0/P_{ag})^{0.725} * (1.329*10^{-2}*L_0+5.354)*10^{-2}$$

DETAILED DESCRIPTION OF THE INVENTION

Figure 1A:
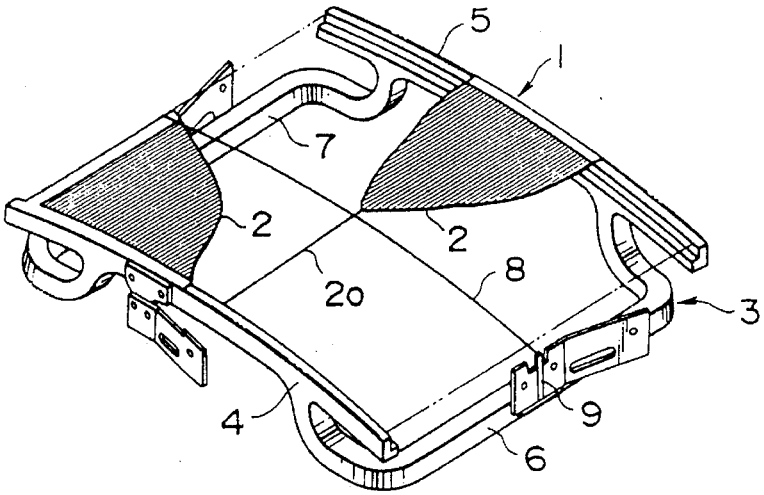
FIG. 1(A) is a perspective view showing an example of an aperture grill of a color cathode ray tube of the present invention.
Figure 1B:
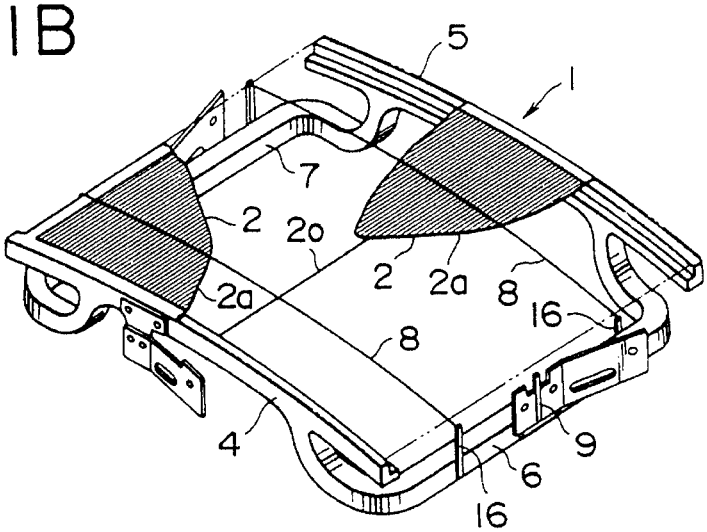
FIG. 1(B) is a perspective view showing another example of an aperture grill of a color cathode ray tube of the present invention.
Figure 1C:
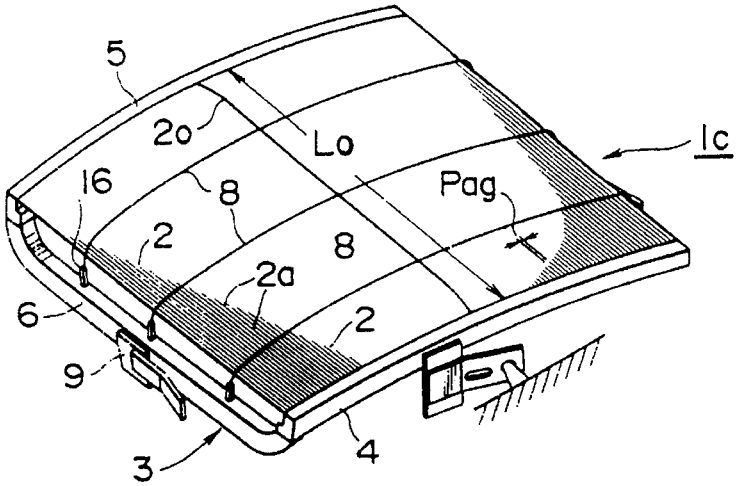
FIG. 1(C) is a perspective view showing another example of an aperture grill of a color cathode ray tube of the present invention.
Figure 7:
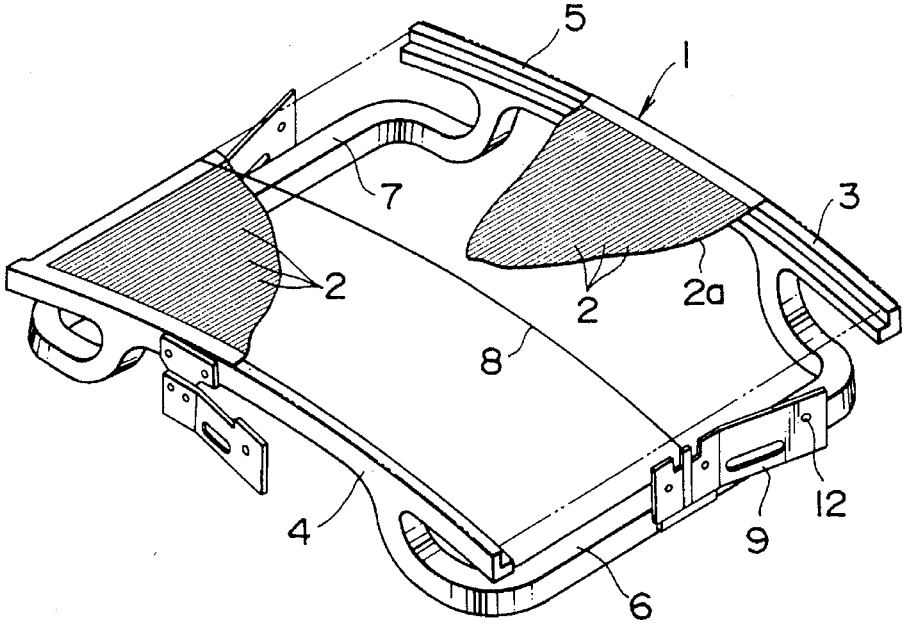
FIG. 7 is a perspective view of an aperture grill.

FIG. 1(A), FIG. 1(B) and FIG. 1(C) are respectively a perspective view showing an example of an aperture grill of a color cathode ray tube of the present invention. FIG. 1(A) shows an aperture grill a damper line attached thereto. FIG. 1(B) shows an aperture grill two damper lines attached thereto. FIG. 1(C) shows an aperture grill three damper lines attached thereto. The frame type shown in FIG. 1(A) and FIG. 1(B) is the same as that shown in FIG. 7. The frame type shown in FIG. 1(C) is different from that shown in FIG. 7.

The color cathode ray tube of the present invention has the aperture grill of which the inside stress $\alpha$ of the grill tape is more than $(L_0/P_{ag})^{0.725}*(1.329*10^{-2}*L_0+5.354)*10^{-2}$ [Kg/mm$^2$] regardless of the size of the cathode ray tube and the number of the damper line. Here, $L_0$ [mm] is the length of the center grill tape. $P_{ag}$ [mm] is the pitch from a grill tape to a next grill tape.

Figure 2:
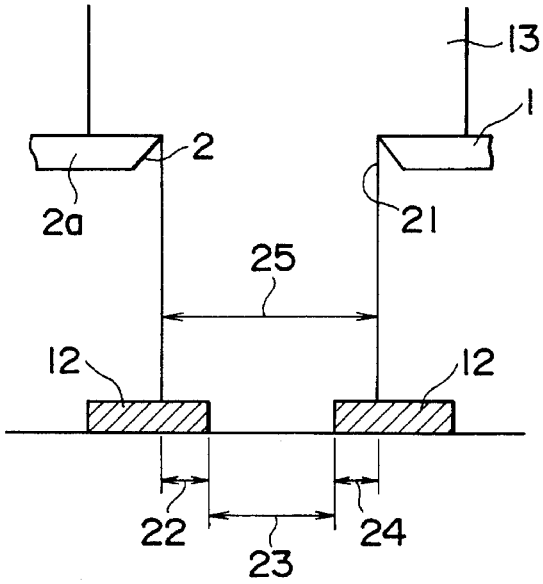
FIG. 2 is a view explaining a "beam lack allowance" for a luminance decline which is caused by a vibration of a grill tape.

Next, the reason why the inside stress $\alpha$ is limited as disclosed above is explained in conjunction with FIG. 2. FIG. 2 is a view explaining the allowance for a luminance decline which is caused by no light emitting area generated in a fluorescent stripe.

Figure 8:
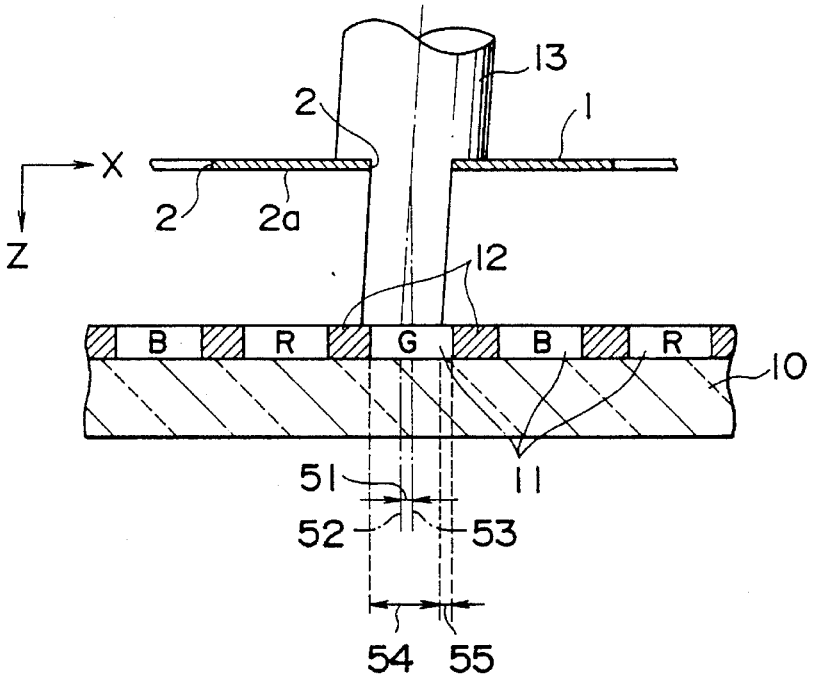
FIG. 8 is a cross-sectional view showing an aperture grill, a fluorescent stripe and a black stripe.
Figure 9A:
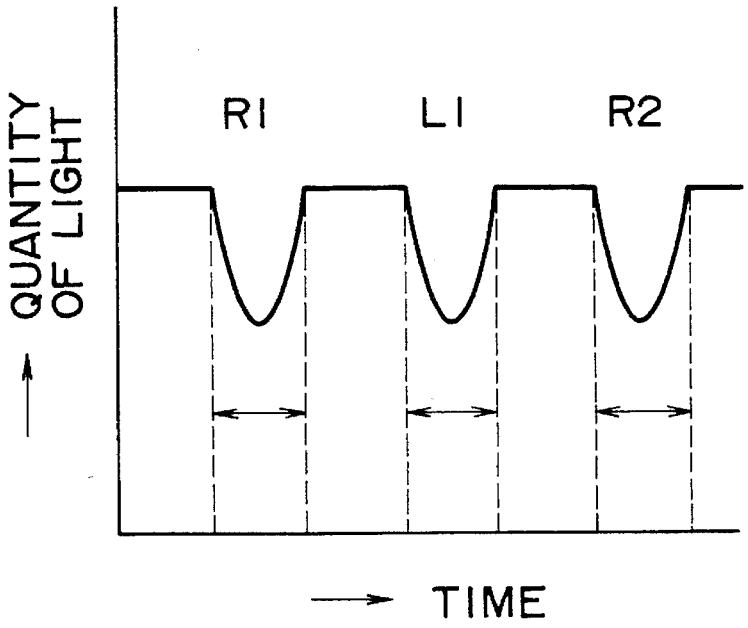
FIG. 9(A) is a graph showing a relation between a quality of light and a time period.
Figure 9B:
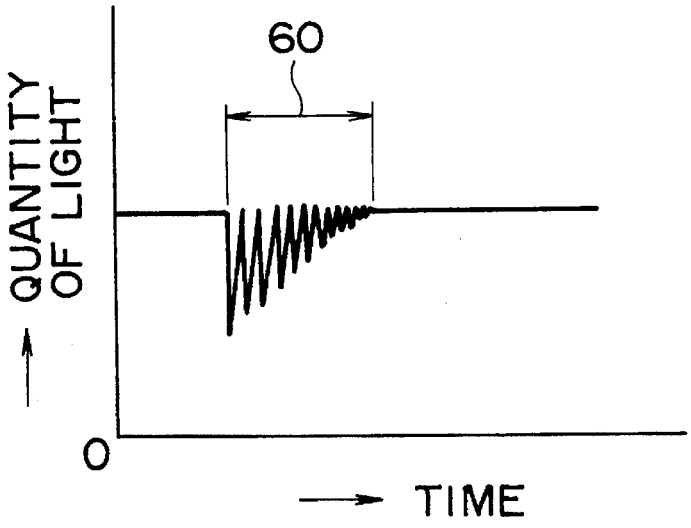
FIG. 9(B) is a graph showing a relation between a quality of light and another time period.

A width 25 of each slit 2 of an aperture grill 1 is greater than a width 23 of a fluorescent stripe. The electron beam passed the slit 2 radiates on the fluorescent stripe and parts of carbon stripes 12. When the center of an electron beam corresponds to the center of a fluorescent stripe, the width 22 or 24 is called "beam lack allowance" ($A_{bk}$). When the center of an electron beam shifts from the center of a fluorescent stripe within the beam lack allowance ($A_{bk}$), the fluorescent stripe is fully illuminated as long as the beam lack allowance is not exceeded by the movement of the aperture grill. Therefore a luminance decline caused by misalignment and generation of an area 55 of FIG. 8 is not generated in a fluorescent stripe according to the present invention.

The beam lack allowance ($A_{bk}$) is calculated as follows: A pitch of an aperture grill is expressed as $P_{ag}$. A pitch of a fluorescent stripe is expressed as $P_{sc}$. $P_{SC}$ is the distance from a red fluorescent stripe to the next red fluorescent stripe.

$$P_{sc}=1.05*P_{ag} \quad (3)$$

A white ratio of a fluorescent screen is expressed as W [%]. A width of a fluorescent stripe is expressed as $W_{ps}$.

$$W_{ps}=(P_{sc}*W/100)/3 \quad (4)$$

A slit width of an aperture grill is expressed as $W_s$. A width of an electron beam passed a slit 25 is expressed as $W_b$.

$$W_b=1.1*W_s \quad (5)$$

$$A_{bk}=(W_b-W_{ps})/2 \quad (6)$$

Here, a slit width of an aperture grill $W_s$ is determined by a transparent ratio $A_{lt}$ and a pitch of an aperture grill $P_{ag}$.

$$W_s=A_{lt}*P_{ag} \quad (7)$$

Figure 3:
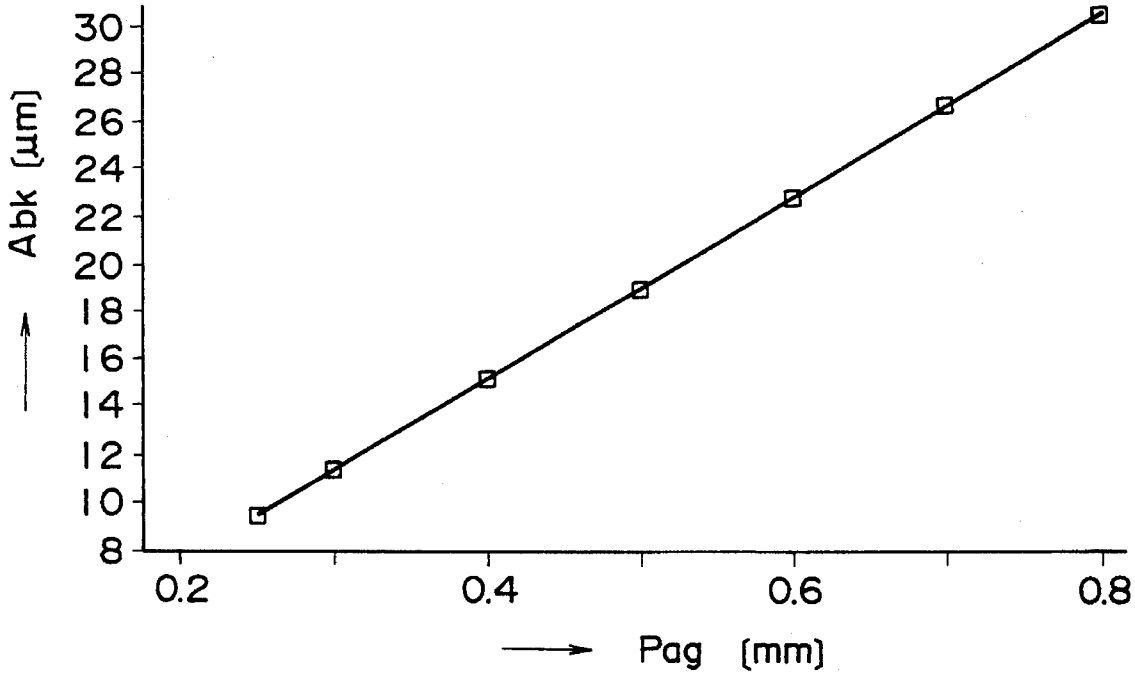
FIG. 3 is a graph showing a relation between a grill tape pitch and a beam lack allowance.

FIG. 3 shows a change of a beam lack allowance $A_{bk}$ when a pitch of an aperture grill $P_{ag}$ is changed in a 20 inch color cathode ray tube. Here, the white ratio W of the fluorescent screen is 60%. The transparent ratio $A_{lt}$ of the aperture grill is 0.26.

As shown in FIG. 3, when a pitch of an aperture grill $P_{ag}$ is smaller, a beam lack allowance $A_{bk}$ is smaller. Therefore for high definition cathode ray tubes, a beam lack allowance $A_{bk}$ will be small. Therefore the picture quality is easily deteriorated by a grill tape vibration.

It has been observed that the picture quality deteriorating time period is longest at the center of a color cathode ray tube. So the picture quality deteriorating time period was measured at the center of a color cathode ray tube in developing the present invention.

A color cathode ray tube having two damper lines was used for this test as shown in FIG. 1(B). The picture quality deteriorating time period $T_g$ was measured for four kinds of color cathode ray tubes. The inside stress $\alpha_0$ of the center grill tape $2_0$ was 7.2 [Kg/mm$^2$] in TABLE 1, EXAMPLE 1. The inside stress $\alpha_0$ of the center grill tape $2_0$ was 8.7 [Kg/mm$^2$] in TABLE 1, EXAMPLE 2. The inside stress $\alpha_0$ of the center grill tape $2_0$ was 11.6 [Kg/mm$^2$] in TABLE 1, EXAMPLE 3. The inside stress $\alpha_0$ of the center grill tape $2_0$ was 13.5 [Kg/mm$^2$] in TABLE 1, EXAMPLE 4. Here, the thickness of the grill tape was 0.13 mm. The grill tape pitch $P_{ag}$ was 0.4 mm. The transparent ratio $A_{lt}$ was 0.26. The length of the center grill tape $L_0$ [mm] was 286 mm. The white ratio W was 60%.

TABLE 1 is the result of the above disclosed test.

TABLE 1

| | | |
|---|---|---|
| 1 | $\alpha_0$ = 7.2 [kg/mm$^2$] | $T_g$ = 0.9 [sec] |
| 2 | $\alpha_0$ = 8.7 [kg/mm$^2$] | $T_g$ = 0.7 [sec] |
| 3 | $\alpha_0$ = 11.6 [kg/mm$^2$] | $T_g$ = 0.4 [sec] |
| 4 | $\alpha_0$ = 13.5 [kg/mm$^2$] | $T_g$ = 0.3 [sec] |

Figure 4:
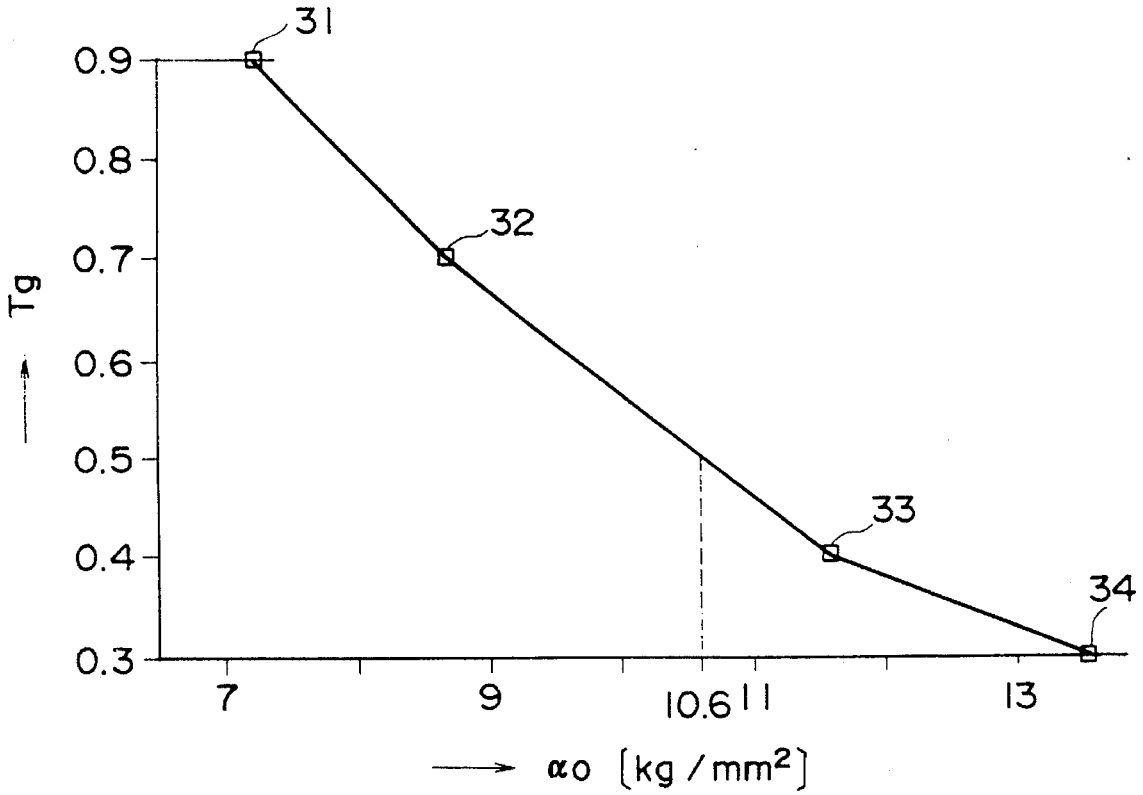
FIG. 4 is a graph showing a relation between an inside stress of a grill tape and a picture quality deteriorating time period.

FIG. 4 shows the relation between the inside stress $\alpha_0$ of the center grill tape $2_0$ and the picture quality deteriorating time period $T_g$ based on TABLE 1.

When the inside stress $\alpha_0$ of the center grill tape $2_0$ becomes greater, the picture quality deteriorating time period $T_g$ becomes shorter as shown in FIG. 4. When the inside stress $\alpha_0$ of the center grill tape $2_0$ is 10.6 [Kg/mm$^2$], the picture quality deteriorating time period $T_g$ is 0.5 seconds.

TABLE 2 shows the inside stress $\alpha_0$ of the center grill tape $2_0$ when the picture quality deteriorating time period $T_g$ is 0.5 seconds for three kinds of color cathode ray tubes (EXAMPLE 1–EXAMPLE 3).

TABLE 2

| $P_{ag}$ [mm] | $\alpha_0$ [kg/mm$^2$] for Example 1 | $\alpha_0$ [kg/mm$^2$] for Example 2 | $\alpha_0$ [kg/mm$^2$] for Example 3 |
|---|---|---|---|
| 1.0 | 6.9 | | |
| 0.8 | 8.0 | 6.8 | |
| 0.6 | 10.5 | 8.3 | 5.0 |
| 0.4 | 14.0 | 10.6 | 7.0 |
| 0.3 | 15.8 | 12.7 | |
| 0.25 | | | 10.5 |

In TABLE 2, the dimension of a pitch of an aperture grill (AG) $P_{ag}$ is mm. The dimension of an inside stress $\alpha_0$ is Kg/mm$^2$. The value shown underlined in TABLE 2 shows the inside stress $\alpha_0$ on the pitch of a conventional aperture grill $P_{ag}$.

TABLE 3 shows the conditions of the three kinds of color cathode ray tubes. A cathode ray tube shown in FIG. 1(C) is used for EXAMPLE 1. A cathode ray tube shown in FIG. 1(B) is used for EXAMPLE 2. A cathode ray tube shown in FIG. 1(A) is used for EXAMPLE 3.

TABLE 3

| | Example 1 | Example 2 | Example 3 |
|---|---|---|---|
| CRT size | 25" | 20" | 14" |
| AG thickness | 0.15 | 0.13 | 0.10 |
| $L_0$ | 339 | 286 | 197 |

TABLE 3-continued

Figure 5A:
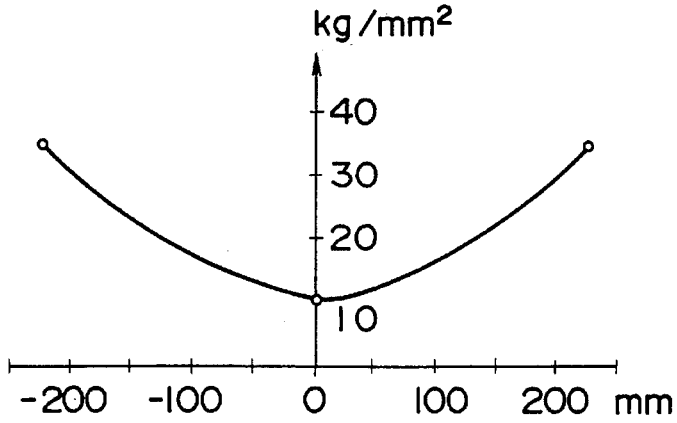
FIG. 5(A) is a graph showing an inside stress distribution of a grill tape of EXAMPLE 1.
Figure 5B:
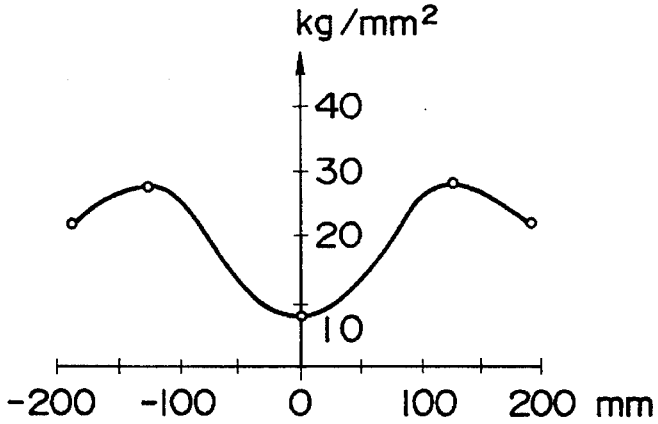
FIG. 5(B) is a graph showing an inside stress distribution of a grill tape of EXAMPLE 2.
Figure 5C:
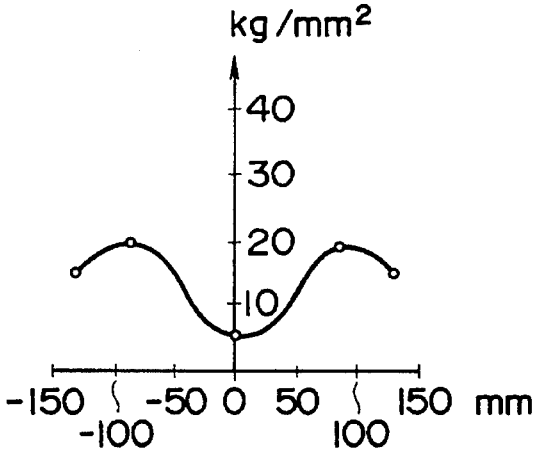
FIG. 5(C) is a graph showing an inside stress distribution of a grill tape of EXAMPLE 3.

| | Example 1 | Example 2 | Example 3 |
|---|---|---|---|
| $A_{lt}$ | 0.26 | 0.26 | 0.26 |
| W | 60% | 60% | 60% |
| Frame Type | FIG. 1(C) | FIG. 1(B) | FIG. 1(A) |
| No. Dampers | 3 | 2 | 1 |
| Damper diameter | 20 μm | 20 μm | 15 μm |
| Stress Distrib. | FIG. 5(A) | FIG. 5(B) | FIG. 5(C) |

The stress distribution of the aperture grill of EXAMPLE 1 in the horizontal direction is shown in FIG. 5(A). The stress distribution of the aperture grill of EXAMPLE 2 in the horizontal direction is shown in FIG. 5(B). The stress distribution of the aperture grill of EXAMPLE 3 in the horizontal direction is shown in FIG. 5(C).

Figure 6:
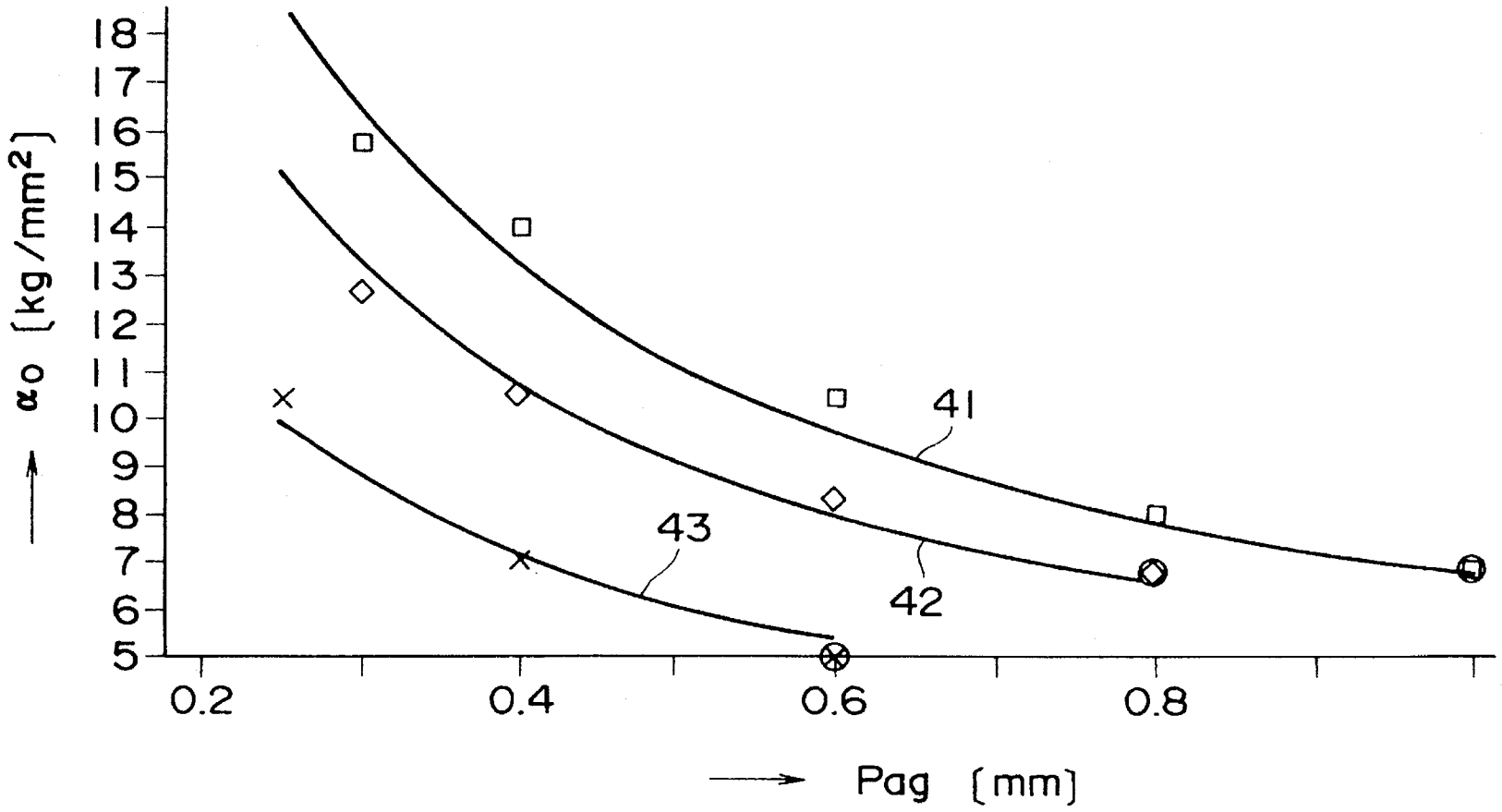
FIG. 6 is a graph showing a relation between a grill tape pitch and an inside stress based on TABLE 2.

FIG. 6 is a graph illustrating the results tabulated in TABLE 2. FIG. 6 shows the relation between the inside stress $\alpha_0$ of the center grill tape $2_0$ and the grill tape pitch $P_{ag}$ when the picture quality deteriorating time period $T_g$ is 0.5 seconds. Line 41 shows the result of EXAMPLE 1. Line 42 shows the result of EXAMPLE 2. Line 43 shows the result of EXAMPLE 3. Here, the length of the center grill tape $L_0$ is changed as a parameter.

The following formula is obtained by the data of the test.

$$\alpha_0=(L_0/P_{ag})^{0.725}*(1.329*10^{-2}*L_0+5.354)*10^{-2}\ [Kg/mm^2] \quad (8)$$

The formula (8) is determined regardless of the number of a damper lines (but at least one damper line is provided) and the size of a color cathode ray tube. Of course, this formula was developed empirically to achieve a picture quality deteriorating time period of 0.5 seconds or less as a target. Those skilled in the art will appreciate that other targets will produce varying results.

The formula (8) is obtained at the center grill tape of an aperture grill. The inside stress of the center grill tape is smallest regardless of the type of a cathode ray tube. The stress distribution pattern in which an inside stress is smallest at the center of an aperture grill is similar to that of another color cathode ray tube having an aperture grill. TABLE 1 shows that the picture quality deteriorating time period becomes shorter when the inside stress of a grill tape becomes greater.

Eye observation of a color cathode ray tube resulted that the picture quality deteriorating time period at the center of a screen is longest regardless of a frame type. The reason is that the inside stress of a grill tape is smallest at the center of a color cathode ray tube.

Therefore when the inside stress $\alpha$ of each grill tape is greater than the inside stress $\alpha_0$ obtained by the formula (8), the picture quality deteriorating time period $T_g$ becomes not greater than 0.5 seconds. Thereby, the picture quality deterioration which a viewer feels uncomfortable is prevented.

While this invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as falling within the scope of the appended claims.

What is claimed is:

1. A cathode ray tube having an electron beam source, comprising:

a glass panel having a plurality of fluorescent stripes thereon and a plurality of black stripes located between two adjacent fluorescent stripes;

an aperture grill located between said electron beam source and said glass panel, a plurality of grill tapes provided in parallel to each other between an upper part and a lower part of said aperture grill, a plurality of slits provided between two adjacent grill tapes, an inside stress of a center grill tape expressed by α, a length of said grill tape provided at a center of said aperture grill expressed by $L_0$, a grill tape pitch of said aperture grill expressed $P_{ag}$; and wherein an inside stress of said center grill tape is expressed by the following formula:

$$\alpha > (L_0/P_{ag})^{0.725} * (1.329*10^{-2} * L_0 + 5.354) * 10^{-2}$$

2. A cathode ray tube according to claim 1 further including at least one damper extending between opposite sides of said aperture grill for restraining each said grill tape.

3. A cathode ray tube according to claim 1 wherein a stress distribution of said inside stresses of said grill tapes is a minimum at said center grill tape.

4. An aperture grill for a color cathode ray tube, comprising:

a plurality of grill tapes provided in parallel to each other between an upper part and a lower part of said aperture grill, a plurality of slits provided between two adjacent grill tapes, an inside stress of a center grill tape expressed by α, a length of said grill tape provided at a center of said aperture grill expressed by $L_0$, a grill tape pitch of said aperture grill expressed $P_{ag}$; and wherein an inside stress of said center grill tape is expressed by the following formula:

$$\alpha > (L_0/P_{ag})^{0.725} * (1.329*10^{-2} * L_0 + 5.354) * 10^{-2}$$

wherein the inside stress of said center grill tape is the smallest stress level in a stress distribution of inside stress levels for said grill tapes.

5. A color cathode ray tube according to claim 4 further including at least one damper extending between opposite sides of said aperture grill for restraining each said grill tape.

6. A color cathode ray tube according to claim 4 wherein a picture quality deteriorating time period for said tube is less than 0.5 seconds.

7. A color cathode ray tube having an electron beam source, comprising:

a glass panel having a plurality of fluorescent stripes thereon and a plurality of black stripes located between two adjacent fluorescent stripes;

an aperture grill located between said electron beam source and said glass panel, a plurality of grill tapes provided in parallel to each other between an upper part and a lower part of said aperture grill, a plurality of slits provided between two adjacent grill tapes, an inside stress of said grill tape expressed by α, a length of said grill tape provided at a center of said aperture grill expressed by $L_0$, a grill tape pitch of said aperture grill expressed $P_{ag}$;

wherein an electron beam emitting from said electron beam source goes through said slit to cause said fluorescent stripe radiate, a relation among said inside stress of said grill tape, said length of said grill tape provided at said center of said aperture grill and said grill tape pitch of said aperture grill is expressed by a formula $$\alpha > (L_0/P_{ag})^{0.725} * (1.329*10^{-2} * L_0 + 5.354) * 10^{-2}.$$

8. A color cathode ray tube according to claim 7, at least one damp line is stretched between a right side and a left side of said aperture grill on said aperture grill.

9. A color cathode ray tube according to claim 7 wherein a picture quality deteriorating time period for said tube is less than 0.5 seconds.

* * * * *